United States Patent [19]

Sterner

[11] Patent Number: 5,006,012

[45] Date of Patent: Apr. 9, 1991

[54] COMBINATION ROAD REPAIR MACHINE WITH IMPROVED CRACK-FILLING CAPABILITIES

[76] Inventor: Carl L. Sterner, 3860 North Rd., Bakersfield, Calif. 93312-9216

[21] Appl. No.: 321,591

[22] Filed: Mar. 9, 1989

[51] Int. Cl.[5] ..... E01C 23/02

[52] U.S. Cl. ..... 404/107; 404/111

[58] Field of Search ..... 404/111, 107

[56] References Cited

U.S. PATENT DOCUMENTS

| | | | |
|---|---|---|---|
| 1,397,045 | 11/1921 | Finley | 404/111 |
| 3,625,120 | 12/1971 | Nogy | 404/107 |
| 4,423,980 | 1/1984 | Warnock | 404/111 |
| 4,511,284 | 4/1985 | Sterner | 404/111 |
| 4,579,479 | 4/1986 | Bryant | 404/107 |
| 4,695,186 | 9/1987 | King | 404/111 |
| 4,820,078 | 4/1989 | Bracious | 404/111 |
| 4,828,429 | 5/1989 | Kirchner et al. | 404/111 |

FOREIGN PATENT DOCUMENTS

| | | | |
|---|---|---|---|
| 2346212 | 3/1974 | Fed. Rep. of Germany | 404/111 |
| 2530694 | 1/1984 | France | 404/107 |
| 0732433 | 5/1980 | U.S.S.R. | 404/107 |

*Primary Examiner*—Ramon S. Britts
*Assistant Examiner*—Gay Ann Spahn

[57] ABSTRACT

A vehicle for transporting and dispensing materials required for filling and repairing cracks in roadways and highways and the like is disclosed. The vehicle comprises a tank for carrying asphalt mix or emulsion or the like liquid crack-filling material, a hose connected to the tank for moving the crack-filling material from the tank to a dispensing area adjacent the vehicle, a manually directable applicator wand connected to the hose for manually directing crack-filling material from the tank into cracks in the roadway, a hopper for carrying sand, rock chips, or other substantially dry structural material for covering the liquid crack-filler material and binding therewith to form a substantially firm roadway surface, a conveyor interconnected with the hopper for moving sand or other structural filler material therefrom to the dispensing area adjacent the vehicle, and controls for driving the vehicle positioned on the vehicle immediately adjacent the dispensing area such that the dispensing area is clearly viewable by an operator at the driving control position.

5 Claims, 2 Drawing Sheets

COMBINATION ROAD REPAIR MACHINE WITH IMPROVED CRACK-FILLING CAPABILITIES

BACKGROUND OF THE INVENTION

The present invention relates to a machine for roadway repair and crack-filling operations, and in particular to a machine having applicators for manually directing asphalt, ductile emulsion or other fluid crack-filling material into cracks, crevices, holes or the like defects in roadways, streets or highways and having an adjacent supply station for sand, gravel or other aggregate material which can be applied to fluid-filled cracks.

Known roadway or highway crack-filling operations typically involve the use of a kettle or tank, sometimes heated, with or without an agitator to stir the crack-filling material. The tank or kettle is mounted on a truck bed or trailer which is moved along a roadway to be repaired. Applicator brushes, swabs or the like are dipped into the tank and then onto the roadway defects, as the tank is moved along. Alternatively, some operations use hoses leading from such truck bed or trailer-mounted tank to an applicator wand which is operated manually to place crack-filler material into the irregular defects or cracks. The truck bed or trailer is moved along with the wand operators following and filling the cracks. The crack-filling material, whether heated asphalt or a ductile emulsion, rapidly begins to harden after it is applied. The sand or aggregate to be most effective must be applied while the filler material is still fluid. The wand operator is, therefore, followed closely by a dump truck filled with sand. A sand shoveler typically walks along the roadway and shovels sand from the dump truck bed onto the filled cracks. With a normally configured rear bed dump truck, the dump truck is backed slowly behind both the wand operator and the sand shoveler by a truck driver. Sand or aggregate is moved to the rear of the bed by tilting the bed up at the front. The operation requires at a minimum four workers, one to drive the truck or trailer carrying the fluid crackfiller material, one to operate the applicator wand, one to shovel sand or aggregate, and one to back the sand truck. This operation also results in the sand truck operator having limited or completely blocked view of the other workers not only because the dump truck is backing up but also because the bed of the dump truck is typically raised or inclined to cause the sand to move to the end of the dump truck bed where it can be reached for shoveling.

In other road repair devices, cracks are in effect filled by spreading the fluid filler material across the entire road surface and subsequently spreading sand or gravel chips over the entire layer of fluid material, asphalt or ductile emulsion. Such an operation typically requires an asphalt sprayer vehicle to move along a roadway at a substantially constant slow speed, followed by a sand, gravel, rock-chip, or aggregate spreader vehicle traveling at about the same speed. In some applications, the fluid sprayer vehicle travels ahead of the aggregate spreader driven in reverse. In other operations, the sand or rock chips are conveyed or moved to the front of a special truck fitted with an aggregate spreader device such as a laterally disposed auger spreader or twin spinning spreaders, both of which can provide substantially even layers of sand or gravel ahead of the spreading truck.

Whether a localized crack-filling or an entire roadway covering is being accomplished, there is an attempt to avoid driving the truck tires on the fluid applied area before the sand or aggregate is applied. It is important to avoid both dangerous slipping conditions as well as accelerated tire deterioration caused by rolling the rubber tires of the vehicles directly through the fluid asphalt or the ductile emulsion again, these methods of road repair require at least two trucks. In the case of minor and spaced-apart cracks, which are typical in many roads at early stages of deterioration, the cost of additional manpower of applicator wand operators and sand shovelers is offset by the savings in materials over the spreading method.

The present invention overcomes many of the disadvantages associated with the prior devices and methods for crackfilling and road repairing by providing a single vehicle for carrying and supplying fluid crack-filler, material and sand to a working area. The vehicle both carries and supplies asphalt filler material and sand or gravel to a single end of the combination vehicle. The vehicle is configured to permit the driver of the vehicle to have a clear view of both the applicator wand operator and the sand shoveler when used in the individual crack-filling mode. Further, the vehicle incorporates a fluid sprayer and a sand or rock-chip spreader, both of which can be used to trail the vehicle during operation so that the vehicle wheels do not roll through the liquid asphalt material. Further, when operated as a surface spreader, the vehicle need not even roll on the freshly laid layer of aggregate or rock chips This reduces contact between the tires and the asphalt and also reduces trackmarks in the solidifying materials.

The objects and the advantages of the present invention can be more fully understood with reference to the drawings in which like numerals indicate like elements and in which.

DETAILED DESCRIPTION OF THE DRAWINGS

Figure 1:
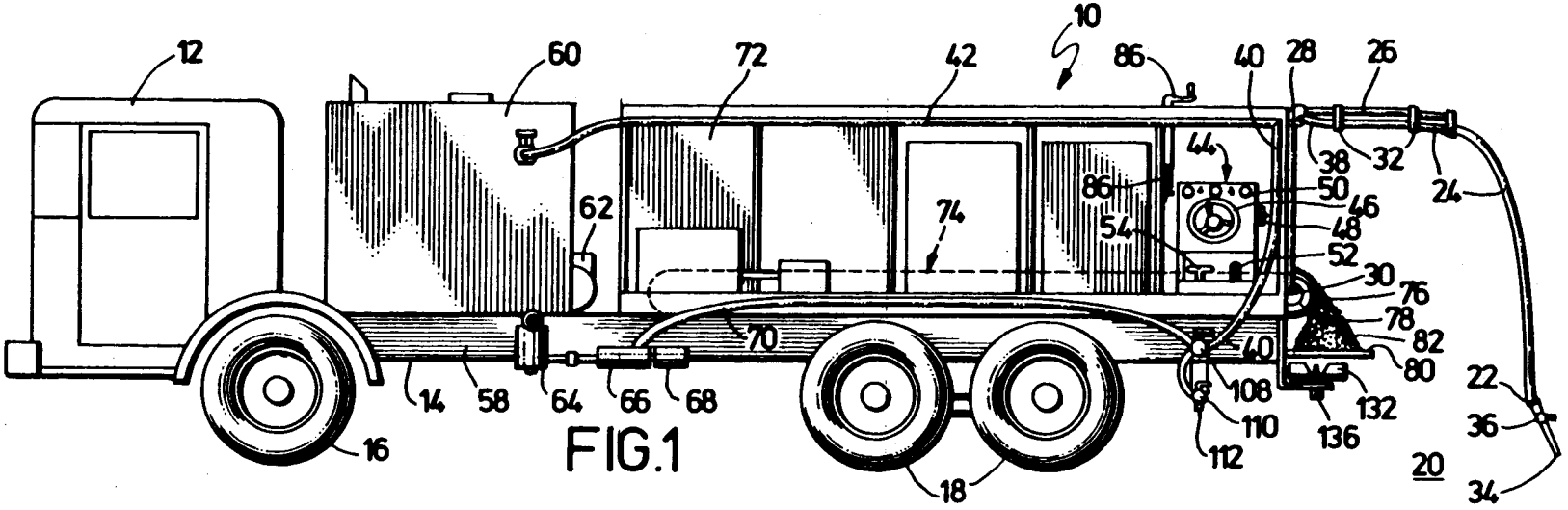
FIG. 1 is a side view of the inventive combination crack-filling vehicle.

FIG. 1 is a schematic side plan view of the crack-filling vehicle 10 which is depicted in a preferred embodiment as a truck having a cab portion 12 and a trailer portion 14. Vehicle 10 is shown with a front pair of tires 16 and rear pairs of tires 18. It will be understood that other known means of locomotion for vehicle 10 can be used provided such locomotion means is compatible with the roadway for which repair or crack-filling function is intended. Also, the vehicle 10 may be constructed with the cab 12 and the frame 14 intregally connected or may comprise a motorized cab 12 and a pivotably connected trailer 14. However, it is preferable and advantageous that the cab and frame be integrally formed for ease of steering operations as discussed below.

In FIG. 1, a dispensing area 20 is depicted adjacent vehicle 10 into which dispensing area 20 a crack-filling material applicator wand 22 is extended from vehicle 10 via a fluid supply hose 24 supported by a boom support 26. Boom support 26 is preferably suspended from the top of the vehicle 10 in a manner which will permit it to extend into the dispensing area 20. Advantageously, boom 26 can be pivoted about swivel mounting means 28 and for additional rigidity may also include a lower swivel bearing 30. The supply hose 24 is supported overhead from boom 26 in a conventional manner such as with multiple support bands 32. This permits a crack-filling operator to walk unobstructed in dispensing area 20 holding fluid applicator wand 22. The wand operator can manually direct the dispensing end 34 of the wand 22 at the roadway cracks within a dispensing area 20 without interference from a dragging hose.

A valve 36 is operated to regulate the flow of fluid to dispense sufficient quantity of fluid into the individual cracks continuously and accurately while the vehicle 10 is moved along the roadway. Sufficient slack is provided in supply hose 24 such that it will conveniently flex at 38 while remaining connected to a pressurized portion 40 of supply hose 24 from which the crack-filling fluid material is received. Valve 36 can be closed and opened as needed without adverse consequences because the pressurized supply hose is connected with a bypass hose 42 which allows the fluid to continue to cycle without clogging, coagulation or overpressurization.

It is an important advantage of this invention that it provides the operator of vehicle 10 with a clear view of the dispensing area so that the vehicle 10 can be moved at a rate consistent with that of the manual filling of cracks. The speed of the vehicle can be safely and efficiently varied according to the rate of crack filling which depends on the experience of the worker and the number of cracks to be filled at a given location. For example, the roadway may have multiple cracks to be filled or only a few cracks to be filled such that the speed with which the vehicle can be moved to maintain efficient crack-filling is not constant. Thus, the improved dispensing crack-filling vehicle 10 provides a control station 44 located adjacent the dispensing area 20 in a manner which provides the vehicle operator with a clear view of the dispensing area 20 so that the operators of applicator 22 and others in the dispensing area can be observed as to their rate of crack-filling.

The control station 44 comprises vehicle steering controls 46, gear-shifting controls 48, and a control panel 50 by which the operations of the various apparatus on the combination vehicle 10 can be monitored Accelerator control 52 and brake control 54 are preferably mounted as with conventional automotive accelerator and brake pedals for foot operation adjacent a seat 56. In the embodiment shown in FIG. 1, the dispensing area 20 is located at the rear of the vehicle 10 and the vehicle has controls at a rear position 44 which are in addition to controls located in cab 12. The dual nature of the controls is accomplished by providing redundant steering, braking and shifting controls which can be selectably activated.

The vehicle 10 has a tank 60 mounted to its vehicle frame 58 for carrying the supply of asphalt or ductile emulsion In the case of a rubberized asphalt or other material requiring elevated temperatures to maintain the proper consistency and fluidity, a heater 62, such as a kerosene burner, is provided appropriately connected to the tank 60, for safe heat transfer to the content of tank 60. The crack-filling material is moved from the tank 60 to the wand 22 through a strainer 64 which is fluidly connected to a pump 66. Pump 66 may be a gear pump as is known in the art driven by a motor 68. The pump 66 is in turn connected with a rearwardly extending hose portion 70 of a supply hose 40. This permits the fluid crack-filler supply tank to be located on the vehicle 10 at a substantial distance from the dispensing area. Hose portions 70, 40 and 24 are sized to permit a sufficient quantity of crack-filling fluid to be supplied to wand 22.

The operation of the inventive crack-filling vehicle 10 has advantages over the typical previously known crack-filling operation which involves a fluid crack-filling supply tank to be moved ahead of the operators of the applicators. In the prior methods, a sand truck, which was in previous operations typically a dump truck with a pivotable bed, was backed along behind the applicator operators with shovelers reaching shovels up into the tilted bed of the sand truck and applying sand or aggregate material manually on top of the cracks which have been filled with asphalt or ductile emulsion. Where a single applicator was used and a single sand shoveler was working, the prior operations required also an operator to drive the vehicle which carried or pulled the crack-filler material tank and another operator to back the sand-carrying truck. Further, the prior operations typically did not have the operator of the tank carrying vehicle with a clear view of the applicator operator so that inefficiencies of movement results. Typically, a slower than needed constant rate of speed was chosen to insure that all cracks would be filled. The rate was not easily varied to accommodate the number of cracks being filled at any given location Further, and importantly, when a dump truck loaded with sand was being backed, and particularly when it had its bed raised to permit the sand to move to the end of the bed for shoveling, the view toward the rear of such a dump truck was obscured, creating a hazardous condition both for the applicator operators and the sand shovelers who work in a dispensing area between the two moving vehicles.

The present invention eliminates many of the problems associated with using a separate sand carrying vehicle. The vehicle 10 is provided also with a sand or aggregate carrying hopper 72 with a conveyor means 74 positioned therebelow to move sand or aggregate material from the hopper 72 to a location on the vehicle adjacent dispensing area 20. Conveyor 74 may be a conveyor such as an auger-type conveyor (not shown) or in the preferred embodiment, as shown in FIG. 1, a belt conveyor comprising a continuous belt 76 driven by a motor (not shown). The upper portion of the belt 76 moves through the lower portion of the hopper 72 toward a return roller 78 located immediately adjacent dispensing area 20. In the preferred embodiment, a sand-dispensing platform 80 is located adjacent and below the return roller of the conveyor 74 so that sand or aggregate material falls from the conveyor 76 onto the sand dispensing platform 80.

Platform 80 is mounted in a substantially horizontal position at a height which is convenient for shoveling. It has been found that efficiency is improved by locating this platform 80 at a position between about the knee-height and waist-height for a normal worker. Reduced stooping and reduced reaching minimizes the effort, maximizes the efficiency, and reduces back strain for shovelers. Thus, using platform 80 located at a height of between 1½ and 3 feet will have advantages over using the bed of most dump trucks, which is typically 4 or 5 feet above the ground. Even when the bed of the dump truck is tilted for sand dispensing, it is typically too high for optimum shoveling. It has been found that for most men shoveling down from about 2½ feet high approximates an optimum condition.

Thus, in operation of vehicle 10, a quantity of sand or aggregate material falls to platform 80. A sand shoveler who is walking in dispensing area 20 can follow directly behind the operator of applicator wand 22. Sand is shoveled down from platform 80 directly onto the filled cracks with minimum effort. From the control position 44, the vehicle operator can safely move the vehicle 10 backwards as shown in FIG. 1 as rapidly as the cracks are filled and sand is applied. The sand shovelers and the applicator wand operators are in clear view and thus are not endangered by the moving vehicle 10.

Figure 2:
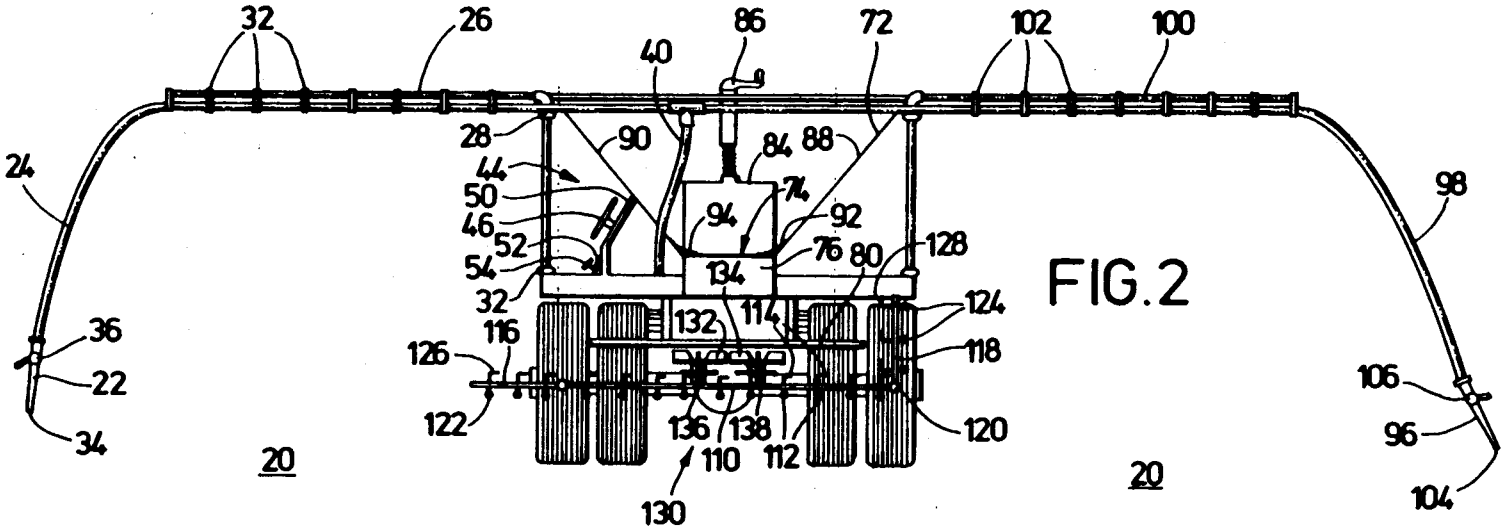
FIG. 2 is a rear plan view of the inventive crack-filling machine.

With reference to FIGS. 1 and 2, it can be more fully understood that the amount of sand deposited on platform 80 depends upon the amount of sand carried by conveyor 74 from "V" hopper 72. This amount can be adjusted, for example, using a slidegate 84 which can be operated upward or downward with an appropriate mechanism. In the embodiment depiected in FIGS. 1 and 2, a screw jack mechanism 86 provides the upward or downward movement of slidegate 84. Other means for adjusting the amount of aggregate conveyed could be used; however, the opening and closing slidegate and positive acting screw jack have been found to be advantageous with a conveyor belt system. The "V" hopper is supported by frame 58 and may extend a substantial length along the vehicle 10. It is preferable to extend the conveyor means along the entire length of "V" hopper 72 so that maximum capacity of the "V" hopper and vehicle can be utilized. Sidewalls 88 and 90 of "V" hopper 72 overlap conveyor belt 74 a small distance, approximately 1 to 2 inches, and are provided with a substantially continuous flexible or rubberized sealing material 92 and 94 at either lower extremity of the hopper walls 88 and 90. Sealing means 92 and 94 rub against the belt as it moves therealong such that significant losses of sand or aggregate at the overlap are avoided.

As will further be understood with reference to FIG. 2, the inventive vehicle 10 may advantageously be provided with an additional applicator wand 96 having a supply hose 98 supported with a boom 100 and attached thereto with support bands 102. The operator adjusts the amount of crackfilling fluid dispensed through applicator wand end 104 using dispensing valve 106. This additional wand permits one operator to use wand 22, and another operator to use wand 96, thereby either covering a larger dispensing area 20, such as two or three lanes of a roadway or, for example, more rapidly filling the cracks in a narrow area such as a single lane on a roadway. In either event, the vehicle operator position 44 is located such that the combined range of dispensing area as determined by the length of hose 24 and boom 26, the vehicle, and the length of boom 100 and hose 98 is viewable. Advantageously, the vehicle can be safely moved in the direction of the operators without endangering the operators with the movement of the vehicle due to poor visibility. Also, in a situation where two wands are being used, the sand-dispensing platform 80 is sufficiently wide to permit a sufficient number of sand shovelers to keep pace with the wand operators. It has been found that with this arrangement, one sand shoveler can usually keep pace with one wand operator.

Again, with reference being had to FIG. 1 in conjunction with FIG. 2, the versatility of the vehicle can be improved to permit spreading of a substantially even layer of asphalt or crackfilling material over an entire roadway surface and covering such substantially evenly spread asphalt or crack-filling material with sand or other aggregate material such as gravel or rock chips. This versatility is provided by constructing platform 80 to be removable from frame 58 of vehicle 10. Also, a valve 108 is interposed in hose 40, which valve 108 permits selectable connection of the supply hose to a spray bar 110 to which multiple spray nozzles 112 are supplied with asphalt or ductile emulsions. Preferably, each spray nozzle 112 is incorporated with an adjustable air-operating control 114 so that the volume and width of the spray emitted from each nozzle 112 can be adjusted. Also, spray bar 110 can be fitted with an extendable portion 116 to increase the width of spray area covered by spray bar 110 while permitting the extendable portion 116 to be retractable to maintain a smaller vehicle width. A second extendable portion 118 is shown in a configuration in which it is retractably pivoted at 120 to provide the extendability as discussed with the corresponding extendable and retractable section 116 located on the other side of the vehicle in FIG. 2. Nozzles 122 and 124 are fitted to extendable portions 116 and 118 respectively, each of which nozzles may be of the same type as nozzles 112 and each of which is provided with controls 126 and 128 respectively. Nozzles 122 and 124 can be shut off when portions 116 and 118 are retracted or pivoted or otherwise retracted to a non-operating position and they can be turned on and adjusted for the desired amount of spray in the extended or outwardly pivoted position.

When the vehicle is operated to spread asphalt and gravel over the entire surface of the roadway as where the minute cracks are so numerous that the entire roadway needs to be covered, the vehicle would typically be operated in a forward direction and with platform 80 removed the sand or aggregate mixture would be dispensed directly onto a spreading means which would preferably trail behind the spray bar 110 in the direction of forward motion.

A spreader means designated generally as 130 is shown in FIGS. 1 and 2. In a spinner mechanism, such as double spinners 132 and 134, each operated with a motor 136 and 138, respectively. Other methods of spreading gravel or sand or aggregate in an even swath may also be used such as a horizontally disposed auger-type chip spreader (not shown) through which the sand or aggregate is dispensed in a substantially even layer could be used. It has been found that the spinners provide certain advantages over the augers such as non-clogging and reduced power consumption and are, therefore, depicted in the preferred embodiment although, as indicated, the auger spreader could be used.

Again, the operator positioned at the control position 44 is advantageous for viewing and monitoring the automatic spreading of the asphalt and the chip layer thereon. Thus, where there are no obstacles in front of the vehicle as in a cordoned off open stretch of highway, the rear controls at position 44 can be preferred for driving the vehicle forward when it is used in the sand or chip-spreading surfacing mode as well as for operating the vehicle in a rearward direction which is preferable for operation of wand crackfilling and sand shoveling. However, it is preferable where obstacles may be present ahead of the vehicle to have an operator in the front or cab portion of the vehicle to provide maximum visibility in the direction of motion and to adjust the speed of the vehicle and flow of the materials to provide an even application of asphalt and aggregate.

In order to maintain compatibility with multiple operation modes, it is preferable to provide dual vehicle operation controls both at the location immediately adjacent the dispensing area, which in the preferred embodiment will be at the rear of the vehicle, and also in the front of the vehicle or in the cab thereof for forward operation. The vehicle can thus move rapidly in the normal high-speed highway operation mode to transport the vehicle to and from the work sight and/or to and from asphalt and sand reloading centers.

What is claimed is:

1. a vehicle for transporting and dispensing materials required for filling and repairing cracks in roadways and highways or similar, said vehicle comprising:

a. a storage tank for asphalt mix or emulsion or the like liquid crack-filling material;

b. hose means leading from said tank to a dispensing area adjacent said vehicle;

c. manually directable applicator wands connected to said hose for manually directing crack-filling material from said tank into cracks in the roadway;

d. a hopper for carrying sand, rock chips, or other substantially dry structural material for covering the liquid crack-filler material and binding therewith to form in the aggregate substantially firm roadway surface;

e. a said dispensing platform attached to said vehicle adjacent said dispensing area;

f. a conveyor interconnected with said hopper for moving sand or other structural filler material therefrom to said dispensing area adjacent said vehicle; and g. controls for driving said vehicle positioned on said vehicle immediately adjacent said dispensing area such that said dispensing area is clearly viewable by an operator at said driving control position.

2. The vehicle for transporting and dispensing materials required for filing and repairing cracks in roadways and highways or similar as in claim 1, further comprising a pivotable boom connected to said vehicle for providing overhead support to said hose and applicator wand a distance ahead of said sanddispensing platform in the direction of motion of the vehicle so that a sand shoveler can apply sand to the filled cracks behind the crack-dispensing operator.

3. A vehicle for transporting and dispensing materials required for filling and repairing cracks in roadways and highways or similar as in claim 1, wherein said sand shoveling platform is positioned for receiving sand or other materials from said conveyor at a height between 1½ feet and 2½ feet from the roadway surface in the dispensing area such that the sand shovelers need not stretch or stoop to reach the sand or material received by sand-shoveling platform while shoveling the sand on filled cracks.

4. The vehicle for transporting and dispensing materials required for filling and repairing cracks in roadways and highways or similar as in claim 1 and wherein the hopper is positioned on said vehicle separate from said dispensing area; and said conveyor is a continuous belt conveyor extending from said hopper to said sand dispensing area.

5. The vehicle for transporting and dispensing materials required for filling and repairing cracks in roadways and highways or similar as in claim 1 where the sand hopper is separate from said dispensing area and said conveyor is an auger in a pipe having an inlet in said hopper and an outlet positioned at said dispensing area.

* * * * *

UNITED STATES PATENT AND TRADEMARK OFFICE

CERTIFICATE OF CORRECTION

PATENT NO. : 5,006,012

DATED : April 9, 1991

INVENTOR(S) : Carl L. Sterner, Jr.

It is certified that error appears in the above-identified patent and that said Letters Patent is hereby corrected as shown below:

Claim 1, column 7, line 24, replace "said", first occurrence, with --sand--.

Signed and Sealed this

Sixth Day of April, 1993

*Attest:*

STEPHEN G. KUNIN

*Attesting Officer*

*Acting Commissioner of Patents and Trademarks*